US005417021A

United States Patent [19]

Tavshanjian

[11] Patent Number: 5,417,021

[45] Date of Patent: May 23, 1995

[54] PORTABLE ROOM DIVIDER

[76] Inventor: B. Armen Tavshanjian, 10 Amanda Dr., Manchester, Conn. 06040

[21] Appl. No.: 144,077

[22] Filed: Oct. 28, 1993

[51] Int. Cl.[6] ..... E04B 2/80

[52] U.S. Cl. ..... 52/243.1; 52/65; 52/126.3; 52/238.1; 160/135; 160/351; 248/200.1

[58] Field of Search ..... 49/50, 55; 52/65, 238.1, 52/243.1, 473, 126.3, 126.4, 764, 240, 241; 160/172 V, 351, 135; 248/200.1

[56] References Cited

U.S. PATENT DOCUMENTS

| | | | |
|---|---|---|---|
| 3,305,983 | 2/1967 | Bus | 52/243.1 |
| 3,453,790 | 7/1969 | Harris | 52/126.3 X |
| 3,521,758 | 7/1970 | Guilfoyle, Sr. | 248/200.1 X |
| 3,631,640 | 1/1972 | Dunne | 52/238.1 |
| 4,277,920 | 7/1981 | Dixon | 52/126.3 X |
| 4,625,476 | 12/1986 | Shimada | 52/238.1 X |
| 4,684,029 | 8/1987 | Righini | 248/200.1 X |
| 5,159,793 | 11/1992 | Deugo et al. | 52/243.1 X |
| 5,201,488 | 4/1993 | Hadbavny | 248/200.1 X |

FOREIGN PATENT DOCUMENTS

| | | | |
|---|---|---|---|
| 2033737 | 3/1972 | Germany | 52/243.1 |
| 2130929 | 6/1973 | Germany | 52/126.4 |
| 488070 | 5/1970 | Switzerland | 52/126.4 |
| 691209 | 5/1953 | United Kingdom | 52/243.1 |

*Primary Examiner*—Carl D. Friedman
*Assistant Examiner*—Kevin D. Wilkens
*Attorney, Agent, or Firm*—M. P. Williams

[57] ABSTRACT

A portable room divider comprises a plurality of slats (10–13) rotatably disposed between a pair of blocks (14, 15) by threads (19, 20) so as to spread the slats (10–13) away from the block (14) when rotated in one direction and draw the slats (10–13) toward the block 14 when rotated in the other direction, whereby the room divider (10–15) can be wedged between a floor and a ceiling, and thereafter released.

12 Claims, 2 Drawing Sheets

PORTABLE ROOM DIVIDER

TECHNICAL FIELD

This invention relates to a room divider which may easily be secured by wedging between the ceiling and the floor, when desired, and easily loosened and moved to another location, when desired.

BACKGROUND ART

There are numerous occasions where it is desired to erect some form of visual barrier so as to preclude unwanted viewing of a room or a portion of a room. At times, there are discontinuities in the floor (carpet/tile, tile/wood) which provide decorating anomalies that are desired to be accommodated. At other times, it may be desirable to add varying degrees of privacy to a large room or a hallway. In some cases, the eye of the decorator may call for a structure in a room, even though none be there.

When a building is being constructed, any number of planned wall structures may be created. After a building is completed, permanent changes in wall structures may be effected utilizing regular construction techniques. However, in many circumstances, the addition of a permanent wall structure may be inadvisable since the desire or need therefor may terminate in a relatively short time. The provision of permanent structural alterations is generally prohibited in rental spaces. In many instances, the value added of a wall structure is less than the cost of a permanent construction change required to effectuate the installation thereof. Although handy persons (do-it-yourselfers) may be able to effectuate changes in wall structures on their own, many persons are not that handy, and are unable to effect changes in wall structures without the aid of a contractor.

DISCLOSURE OF INVENTION

Objects of the invention include provision of false structures which may be installed temporarily, which are easily installed and removed, which can be moved from place to place without leaving telltale damage when removed, which may be provided in a fully assembled form for those who are not handy.

According to the invention, a room divider comprises a plurality of slats, each of which is rotatable relative to a head block and a base block between which the slats are disposed. Each slat is threaded to the block at one end so that rotation thereof will cause the slat to move longitudinally toward or away from such block, while the other end of each slat is free to rotate loosely in the corresponding block. At the threaded end of the slat, one of the two pieces (the slat or the block) has a nut imbedded therein and the other of the pieces (the block or the slat) has a machine screw, such as a carriage bolt (with or without a locking nut) or a lag bolt-/machine screw combination, embedded therein. With a temporary room divider of the invention positioned where it is desired, rotation of each of the slats in the correct direction will cause the two blocks to become wedged between the floor and the ceiling, soffit or other building structure. Rotating the slats in the opposite direction will cause the two blocks to draw closer to each other, and become loose with respect to the building.

According further to the invention, pilot holes for the loose fitting screws in the slats can be made sufficiently long (on the order of three or four inches) so as to permit trimming all the slats so as to fit within rooms having lower ceilings (such as to trim an 8 foot portable room divider according to the invention to fit in a house with 7'9" ceilings), without loosing the registration between the screw at one end of the slat and the screw at the other end of the slat, which allows for proper rotation. In accordance still further with the invention, the room divider may have filler blocks added below the lower block and/or above the upper block so as to permit a room divider of one size to be useful in a room having higher ceilings than the room divider was designed for.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
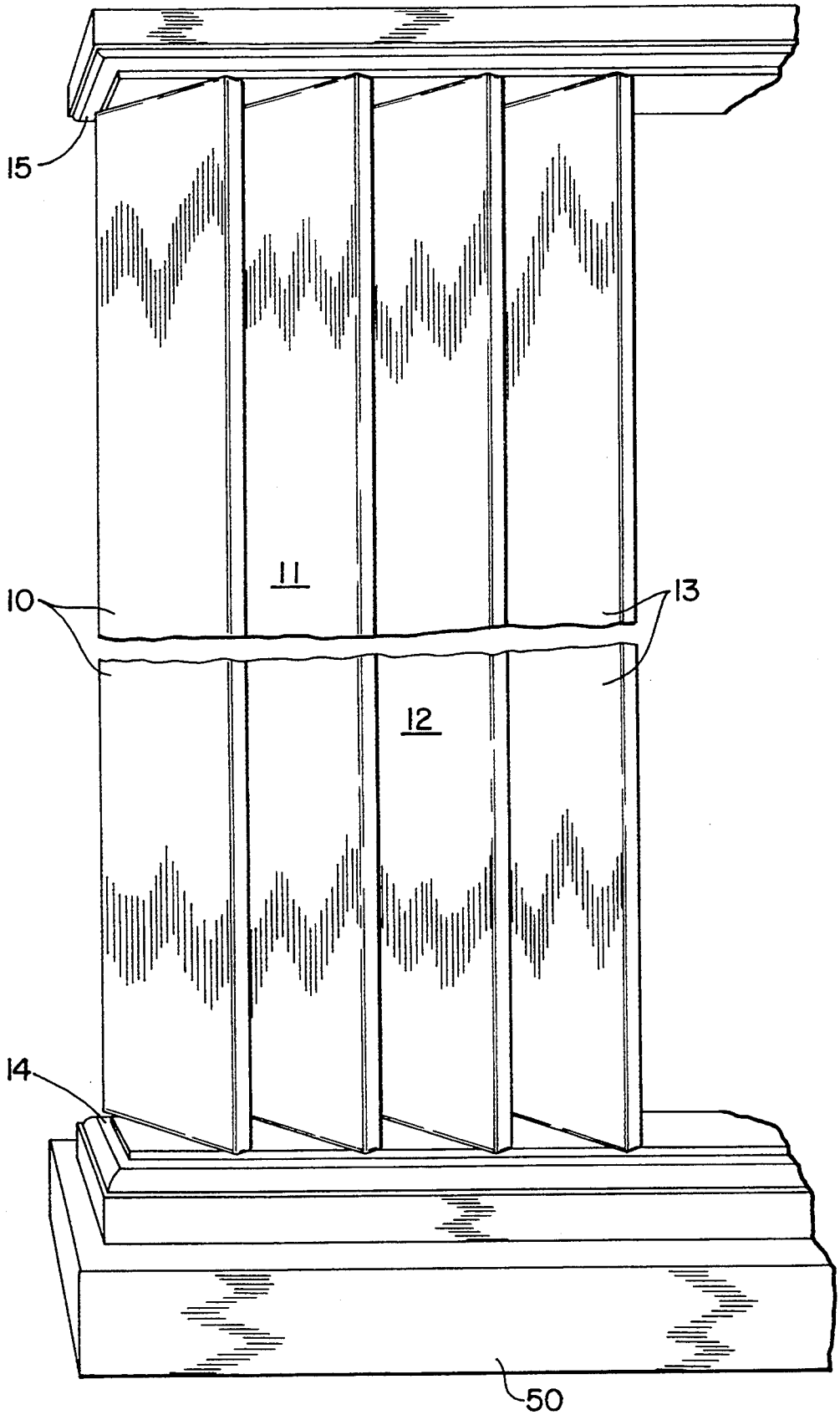
FIG. 1 is a perspective view of a portable room divider in accordance with the present invention.
Figure 2:
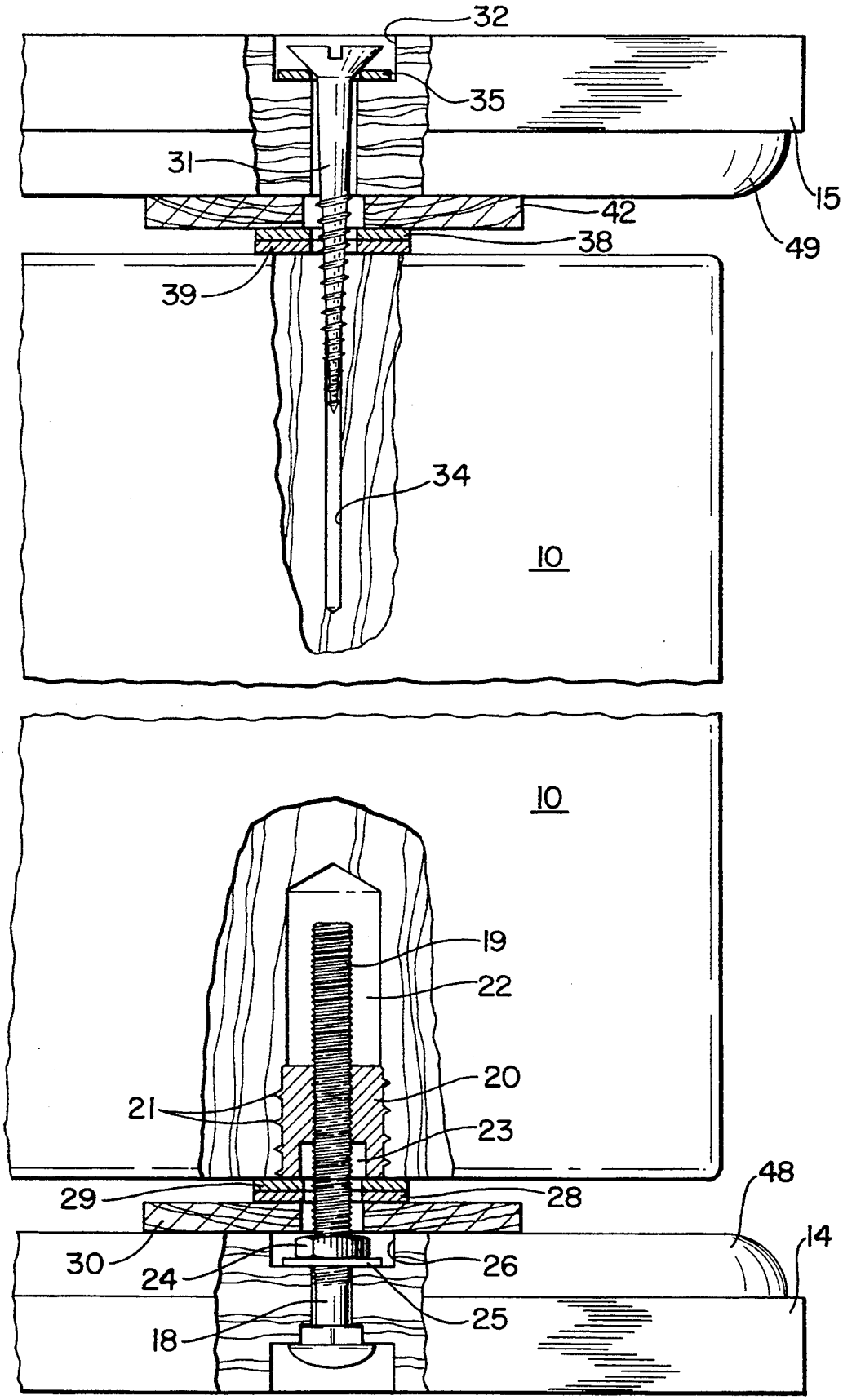
FIG. 2 is a partial, partially broken away and sectioned, side elevation view of the invention.

Referring now to FIG. 1, a portable room divider in accordance with the present invention has a plurality of slats 10–13 disposed between a lower block 14 and an upper block 15. As seen in FIG. 2, each of the slats 10–13 is supported by a carriage bolt 18 having machine threads 19 engaging similar threads of an embedded nut 20. The embedded nut 20 may be of the double-threaded type having coarse exterior threads 21 for engaging the slat 10, by being threaded into a hole 22 drilled in the slat 10, by means of a hex socket 23 within the end of the nut 20 opposite to the end having the machine screw threads. The nut 20 is sufficiently non-rotatable that it will not move in or out of the slat as it rotates on the carriage bolt. The head of the carriage bolt 18 is recessed into the block 14, and embedded against rotation in the known manner. The carriage bolt 18 is also locked against rotation by a nut 24 against a washer 25 within a recess 26. A pair of washers 28, 29 may be positioned between the slat 10 and a lattice strip 30 fastened to the block 14 so as to avoid scuffing the surfaces of either, in the event that the slat 10 is drawn close to the block 14 (as shown).

In the opposite end of each of the slats 10–13, a simple screw 31 (which may be a flat head wood screw, as shown, or a round head screw, a lag bolt or a sheet metal screw) is passed through a clearance hole 32 in the block 15 and threaded into a pilot hole 34 drilled into the slat 10. The head of the screw 31 is free to rotate on a washer 35 (a pair of washers may be used if desired); the flat head screw rotates easily in the washer and is therefore preferred. Similarly, a pair of washers 38, 39 facilitate rotation between the slat 13 and a lattice strip 42 fastened to the block 15. Single washers 28, 38 may be used instead of double washers, if desired. In order to further ensure that the slats 10–13 will not scuff the surface of the blocks 14, 15 as the slats are rotated, each of the blocks 14, 15 are provided with the lattice strips. The lattice strips 30, 42 may extend along nearly the entire length of the blocks 14, 15 and be centered along the row of holes 22, 34.

In operation, rotation of the slats 10–13 in the counterclockwise direction (as seen looking downward in FIGS. 1 and 2) will cause the embedded nut 20 to raise upwardly, thereby creating more space between the slats 10–13 and the base block 14, and, assuming that the blocks 14, 15 are adjacent the floor and the ceiling, respectively, will cause wedging of the blocks 14, 15 between the floor and the ceiling, thereby providing support for the portable room divider of the present invention. Similarly, when the slats 10–13 have been raised from the block 15, rotating the slats 10–13 in a clockwise direction (looking downwardly in FIGS. 1 and 2) will cause the embedded nut 20 to travel downwardly on the bolt 18, thereby drawing the slats 10–13 closer to the base block 14, and allowing the room divider to loosen between the floor and the ceiling so that it can be moved.

In FIG. 2, the pilot holes 34 may be drilled somewhat longer than necessary, such as on the order of three or four inches, if desired, to permit disassembly of the unit, cutting a uniform amount off of each one of the slats 10–13, and reassembling the unit with shorter slats, while maintaining alignment between the holes 34 and the holes 26 in each of the slats 10–13. This is an option which may be used if desired, but need not be.

Instead of having the embedded nuts 20 disposed in the slats 10–13, they could be disposed in the block 14, but this modification restricts the degree of relative motion between the slats 10–13 and the base block 14 unless a deeper base block is used. Therefore, the embedded nuts 20 are preferably in the slats 10–13 as shown. The locking nut 24 and washer need not be used, if the bolt is otherwise secure from rotation. Instead of a carriage bolt 18, a combined lag bolt/machine screw may have its lag bolt threads threaded into a pilot hole drilled into the base block 14.

In FIG. 2, the blocks 14 and 15 are shown as having been shaped, as if by a router, so as to provide rounded beads 48, 49 therein; but they could have an ogee edge or other shape, or could be plane rectanguloids, without shaping. This is an obvious design choice.

As illustrated in FIG. 1, the room divider 10–15 of the present invention may be utilized with an auxiliary block 50, which may be a block similar to the block 14, or it may be a set of bricks, or anything suited to the particular need. This would allow use of the invention in a room having a ceiling which is higher off the floor than the room divider 10–15 was designed to accommodate. Use of a room divider 10–15 of the invention which is shorter than required for a given room, in conjunction with one or more auxiliary blocks 50, can also facilitate movement of the room divider 10–15 from one part of a room to another, since the room divider can have significantly more clearance between the ceiling and the floor as it is being moved, such clearance being taken up by one or more blocks 50 when the room divider 10–15 is mounted in its desired place.

In one embodiment of the invention, the blocks 14 and 15 comprise 5/4 inch by 6 inch wood, and the slats consist of $3\frac{1}{2}$ inch wide pieces of $\frac{3}{4}$ inch wood. Of course, either can be made out of other materials, particularly plastic-laminate-finished particle board, or, with suitable, obvious modifications, a portable room divider 10–15 of the present invention may be made out of solid or hollow metal or resin based plastic of any suitable type, as well.

The position of the block 14 (with the bolt 18 and nut 20) may be exchanged with that of the block 15 (with the screw 31). However, for support of slats 10–13, the bolt 18 and nut 20 are preferred on the bottom as shown.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A portable room divider, comprising:

a pair of opposed blocks, each having a series of holes, said holes centered laterally within said blocks, each hole in each of said blocks being vertically aligned with a corresponding hole in the other of said blocks;

a plurality of longitudinal slats, each having first and second ends;

a first fastener for each of said slats, each fastener having two mating, threaded parts, a first part of each being disposed in a corresponding one of said holes in a first one of said blocks non-rotatably with respect to said first block and the other part of each being disposed in said first end of the corresponding slat non-rotatably with respect to said corresponding slat but rotatable with respect to the related first part; and a second fastener for each of said slats, each of said second fasteners being rotatably disposed in one of said holes in the second one of said blocks in vertical alignment with a corresponding one of said first fasteners, each of said second fasteners holding said second end of the corresponding slat adjacent to said second of said blocks while allowing the corresponding slat to rotate freely with respect to said second block.

2. A portable room divider according to claim 1 wherein each of said first fasteners includes a carriage bolt.

3. A portable room divider according to claim 2 wherein said carriage bolt is locked to the corresponding one of said blocks by a nut recessed into said block.

4. A portable room divider according to claim 1 wherein each of said first fasteners includes a doubly threaded embedded nut.

5. A portable room divider according to claim 1 wherein each of said first fasteners include a doubly threaded embedded nut disposed in the corresponding one of said slats and a carriage bolt, the head of which is disposed in said one block.

6. A portable room divider according to claim 1 wherein each of said second fasteners comprises a screw passing through a corresponding one of said holes in said second block, the threads of which engage said second end of the corresponding slat, said holes in said second block being clearance holes to said screws.

7. A portable room divider according to claim 1 including a third block contacting a surface of one of said blocks, said surface being opposite to the surface of said one block adjacent said slats.

8. A portable room divider according to claim 1 including a lattice strip extending along one of said blocks with clearance holes for said fasteners aligned with said series of holes, to thereby space the ends of said slats from the related block.

9. A portable room divider according to claim 1 including a lattice strip extending along each of said blocks with clearance holes for said fasteners aligned with said series of holes, to thereby space the ends of said slats from the related block.

10. A portable room divider according to claim 1 including a washer disposed around said fasteners between said slats and one of said blocks.

11. A portable room divider according to claim 1 including a pair of washers disposed around said fasteners between said slats and one of said blocks.

12. A portable room divider according to claim 1 wherein said second fasteners are disposed in pre-drilled holes which extend for a significant length greater than the length of said second fasteners therein.

* * * * *